United States Patent [19]

Livezey

[11] 4,223,659

[45] Sep. 23, 1980

[54] FORCED AIR HEATER

[75] Inventor: David J. Livezey, Kent, Wash.

[73] Assignee: Therm - Air Industries, Inc., Seattle, Wash.

[21] Appl. No.: 812,322

[22] Filed: Jul. 1, 1977

[51] Int. Cl.[2] ..... F24H 3/08

[52] U.S. Cl. ..... 126/66

[58] Field of Search ..... 126/6, 61, 63, 66, 67, 126/70, 121, 81, 318, 140, 110 B; 237/51

[56] References Cited

U.S. PATENT DOCUMENTS

| | | | |
|---|---|---|---|
| 585,490 | 6/1897 | Wormer | 126/318 |
| 620,345 | 2/1899 | Morawetz | 126/9 R |
| 1,679,307 | 7/1928 | Hutchison | 126/67 |
| 1,714,955 | 5/1929 | Helms | 126/121 X |
| 2,083,145 | 6/1937 | Campbell | 126/6 X |
| 2,348,127 | 5/1944 | Grimes | 126/110 B X |
| 2,352,485 | 6/1944 | Kritzer | 126/110 B |
| 2,553,278 | 5/1951 | Rogany | 126/6 |
| 3,976,047 | 8/1976 | Breen et al. | 126/121 |
| 4,007,726 | 2/1977 | Kenchel | 126/67 |
| 4,008,706 | 2/1977 | Buanno | 126/121 |
| 4,085,725 | 4/1978 | Mesenbrink | 126/110 B |

FOREIGN PATENT DOCUMENTS

| | | | |
|---|---|---|---|
| 26117 | 7/1920 | Denmark | 126/66 |
| 87214 | 4/1959 | Denmark | 126/110 B |

*Primary Examiner*—Henry C. Yuen
*Assistant Examiner*—Harold Joyce
*Attorney, Agent, or Firm*—Delbert J. Barnard

[57] ABSTRACT

An air heating chamber is supported to project into a stove through an opening provided in the rear wall of the stove by a mounting plate mounted to the exterior of the stove rear wall. The mounting plate which forms the exterior end wall of the heating chamber, includes laterally spaced heating chamber inlet and outlet openings. A blower is detachably mounted to the exterior of the mounting plate in registration with the heating chamber inlet opening to deliver cool forced air into the heating chamber. After circulating therethrough, the air exits the heating chamber through the outlet opening and flows into a hot air manifold, which is also detachably mounted to the exterior of the mounting plate. The manifold includes an upwardly extending inlet chamber with a hot air inlet at its lower end aligned with the heating chamber outlet opening. A horizontal outlet chamber is attached to the top end of the inlet chamber to extend laterally along the back of the stove. Hot air outlets are provided at each end of the manifold outlet chamber to discharge the heated air horizontally over the top and towards the front of the stove.

6 Claims, 5 Drawing Figures

FORCED AIR HEATER

BACKGROUND OF THE INVENTION

1. Field of the Invention

The present invention relates to improving the room heating capability of stoves, and free standing fireplaces, and more particularly to the provision of a blower driven air heater to be used in conjunction with a stove or freestanding fireplace.

2. Description of the Prior Art

Freestanding fireplaces and stoves, although commonly used in years past for heating a room or a house, have been generally replaced by more modern and efficient heating systems, such as a centrally located furnace used in conjunction with air ducts for distributing the warmed air to various locations in a house. Such furnaces are usually fueled by either stove oil or natural gas. However, due to the dimishing supply of the world's petroleum energy supply and the corresponding increase in the cost of home heating fuels caused thereby, alternative energy sources and home heating devices are being increasingly used. A renewed interest has developed in the conventional fireplace, the freestanding fireplace and stove, including the Franklin type stove, as alternative sources of primary or secondary heat for homes. Despite the fact that fireplaces and stoves are generally less efficient heating devices than more modern heating systems, because of the greatly increasing cost of stove oil and natural gas, the wood or coal burning fireplaces and stoves are becoming relatively more economical to operate.

In general, a freestanding fireplace or stove is more efficient than the conventional fireplace. The amount of heat transferred from the stove to the surrounding area by convection caused by the hot metal stove surfaces is greater than the combined transfer of heat from a fireplace to the adjacent air space due to radiation and convection. Still, compared to most modern heating systems, the stove is a relatively inefficient heating device. Much more air than is needed for efficient combustion of the fuel being used is withdrawn from the room and exhausted up the chimney along with the flue gases. To replace the warm air passing up the chimney, cold air is drawn into the room from the outside.

Numerous devices have been used in an attempt to increase the efficiency of stoves and fireplaces. Generally these devices have consisted of a heat exchanger located in or near the fire, a blower for forcing the room air through the heat exchanger and an outlet for directing the hot air warmed by the heat exchanger back into the room. One well-known expedient conforming to this general description is the hearth type heater having a heat exchanger constructed of an elongated hollow tube extending laterally across and positioned on the floor of a fireplace, with the fire being built above or directly on top of such tube. A blower for forcing room air through the tube is generally attached to one end of the tube heat exchanger and an outlet member for discharging the heated air into the air space being warmed is attached to the opposite end.

Another well-known device is the air heater used as, or in conjunction with, a fireplace grate. One common grate type heater includes a heat exchanger composed of a plurality of air tubes, either aligned with the grate bars, or themselves forming the grate bars. Normally an intake manifold is used to deliver cool room air from the blower to the individual tubes and an outlet manifold is used to collect the warmed air from the tubes and redirect such warm air into the surrounding air space.

Another known grate heating device includes a heat exchanger in the form of an enclosed box with an inlet and outlet opening at its front end for receiving cool air from a blower and for exhausting warmed air into the adjacent air space. The interior of the box includes baffles to deflect air flowing into the box from the blower to insure that such air circulates in an irregular path through the box so that such air remains in the box for a sufficient length of time to be adequately warmed prior to being discharged into the surrounding air space. The top wall of this box has elongated troughs or undulations forming a grate for holding the fuel being burned such as wood or coal.

Numerous drawbacks are common to grate and hearth type heaters. One disadvantage is that such heaters are constructed of a large number of individual parts and/or parts requiring expensive and complicated steps to manufacture, thus resulting in a rather expensive device in comparison to the cost of the stove itself. A second disadvantage of this type of structure is that the blower, providing air to the heat exchanger, is usually located in front of the grate, thereby causing noise from the blower to be emitted into the air space being heated. Another disadvantage is that the unsightly heat exchangers and blowers are visible from the front of the stove, greatly detracting from the appearance of freestanding fireplaces and antique stoves now being commonly used.

A type of air heater particularly adapted to be used in conjunction with stoves has been marketed by Therm-Air Industries, Inc. of Auburn, Washington and is disclosed in Design Patent Appln. Ser. No. 733,010 filed on Oct. 14, 1976, by Leroy A. Stull, of Auburn, Washington. This air heater includes a heat exchanger chamber of generally rectangular cross-section mounted to a stove back wall to extend into the firebox of such stove through an optional flue opening commonly provided in such stove back walls as an alternative location for the chimney pipe outlet. The heat exchanger is supported in such position by a separate mounting plate bolted to the exterior of the stove firebox at the location normally occupied by the optional flue cover plate which has been removed, such mounting plate includes bolt holes in registration with the mounting holes provided in the margin of the stove back wall opening. A blower, through the use of an adapter plate, is bolted to the mounting plate to deliver forced air to the heat exchanger through an inlet hole provided in such mounting plate, which inlet hole is in registration with an air inlet hole provided in the adjacent wall of the air heat exchanger. A plurality of hot air outlet tubes extend forward from the end wall of the heat exchanger opposite the mounting plate, to a location adjacent the front surface of the stove. An advantage of this type of air heater is that because the blower is mounted behind the stove, less noise is emitted from the blower into the air space being heated.

A disadvantage of the above-described stove air heater is that the exhaust tubes, which extend forward from the heat exchanger, are visible from the front side of the stove and thus detract from the appearance of the stove. This is especially true when such heaters are used in conjunction with antique styled Franklin type stoves. Another disadvantage is that because the hot air outlet tubes actually extend through the stove to discharge hot air foreward into the air space in front of the stove, this air heater cannot be operated with the front doors, commonly provided in such stoves, closed. Moreover, sparks and other burning material rising upwardly from the fire can be propelled into the room by the rapidly flowing air being discharged by the outlet tubes. A further disadvantage exists because the mounting holes located in the mounting plate must be in registration with corresponding holes provided in the stove side wall. Therefore, a different mounting plate must be provided with each stove having a different mounting hole pattern. The present invention relates to an improved version of this type of stove air heater.

Examples of the grate type air heaters are disclosed by the following U.S. Pat. Nos.: 3,942,509, granted Mar. 9, 1976, to Glen T. Sasser; and 4,008,706, granted Feb. 22, 1977, to John M. Buanno. An example of a hearth type heater is disclosed by U.S. Pat. No. 2,828,078, granted Mar. 25, 1958, to H. C. Snodgrass. These patents and the prior art that was cited and considered by the Patent Office before granting them, and which is listed on the patents, should be consulted for the purpose of properly evaluating the subject invention and putting it into proper perspective.

SUMMARY OF THE INVENTION

The instant invention relates to a novel forced air heater to be used in conjunction with a freestanding fireplace or stove, in basic form composed of an air heating chamber and a mounting plate forming one end wall of the heating chamber, which mounting plate includes laterally spaced apart air inlet and outlet openings for the heating chamber. A blower means is detachably connected to the outside of the mounting plate for serving to deliver forced, cool room air through the inlet opening and into the heating chamber, wherein such air circulates through the heating chamber prior to flowing into the outlet opening. Air is returned to the room through a hot air manifold detachably connected to the mounting plate, which manifold has a hot air inlet in registry with the mounting plate outlet opening for receiving hot air from the heating chamber. The manifold further includes a hot air outlet spaced above the top of the stove and located to discharge hot air horizontally over the top of the stove. This construction allows the discharged hot air to be further heated as it passes over the hot top surface of the stove.

In use, the air heating chamber of the present invention projects through a stove firebox side opening and into the interior of such firebox. The mounting plate is sized to cover the stove side opening and is connected to the stove side wall to support the heating chamber cantilevered inside the stove firebox.

It is an object of the present invention to provide a forced air heater for a stove to increase the efficiency of such stove without detracting from its appearance.

Another object of the present invention is to provide a low cost, easy to manufacture, stove air heater with a minimum of component parts. This is accomplished by utilizing the mounting plate as one wall of the heat exchanger. Also, by specifying that both the heat exchanger air inlet and outlet openings are located in the mounting plate, air entering the heat exchanger through the inlet opening must reverse its flow direction before reaching the outlet opening, thus creating turbulence in such air flow without having to provide baffles within the heat exchanger. This turbulence increases both the mixing of the air circulating through the heat exchanger chamber so that the air is uniformly heated and also the length of time required for the air to flow through the heating chamber thereby enabling more heat to be transferred to this air.

A further object of the present invention is to provide that the hot air, heated in the heat exchanger, is discharged to flow horizontally over the top of the stove to be further heated by the hot top surface of the stove.

Still another object is to provide an air heater which can be installed in a stove by unskilled labor and without the use of specialized tools.

One more object is to provide an air heater adaptable to different size stove side wall openings. This is accomplished by further aspects of the present invention which specify a heat exchanger mounting plate sized larger than such wall opening, which mounting plate also serves to cover such opening.

An additional object is to discharge the heated air from the rear rather than from the front of the stove so that persons located close to the front of the stove are not injured by such hot air.

DESCRIPTION OF THE PREFERRED EMBODIMENT

Figure 1:
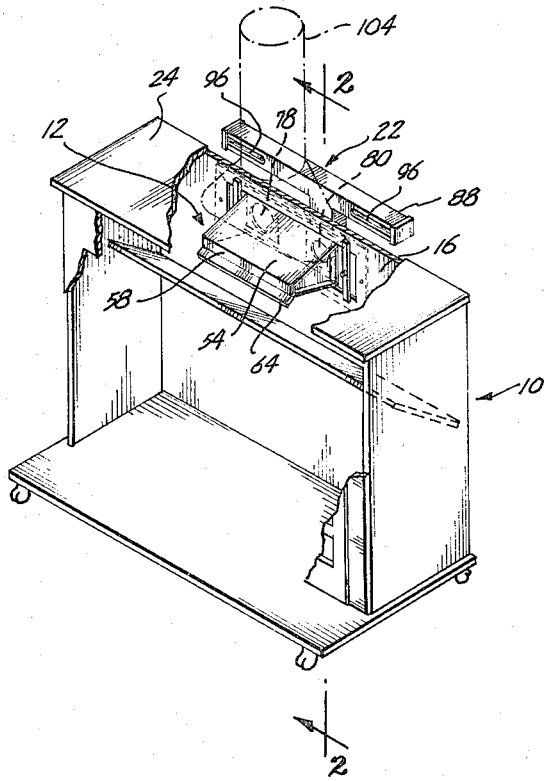
FIG. 1 is a pictorial view of an embodiment of the present invention shown installed in a typical stove, with portions of the stove broken away and the stove pipe in phantom.
Figure 2:
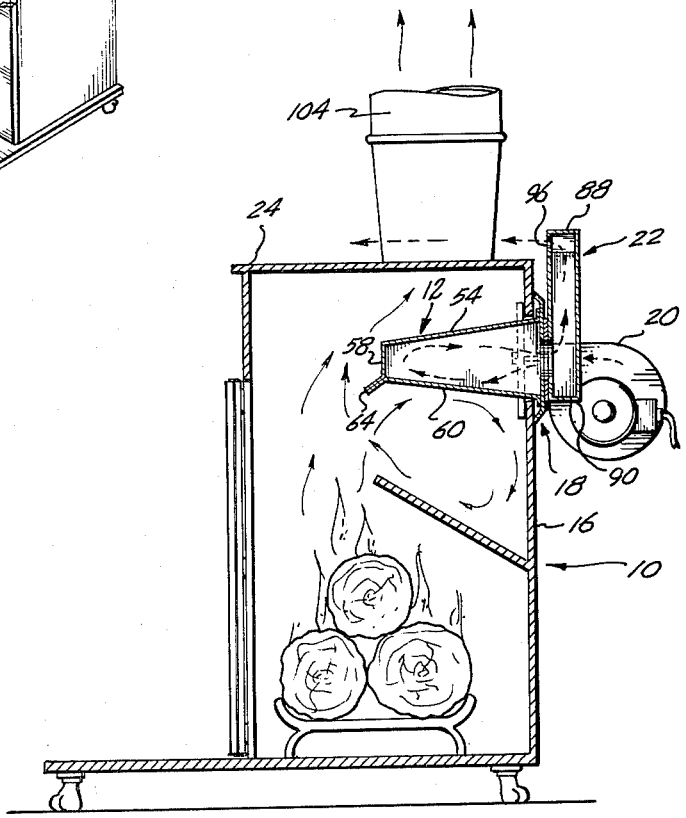
FIG. 2 is a cross-sectional view of the air heater illustrated in FIG. 1 taken substantially along line 2—2 thereof and showing, by the directional arrows, the path of the air flowing through the air heater.
Figure 3:
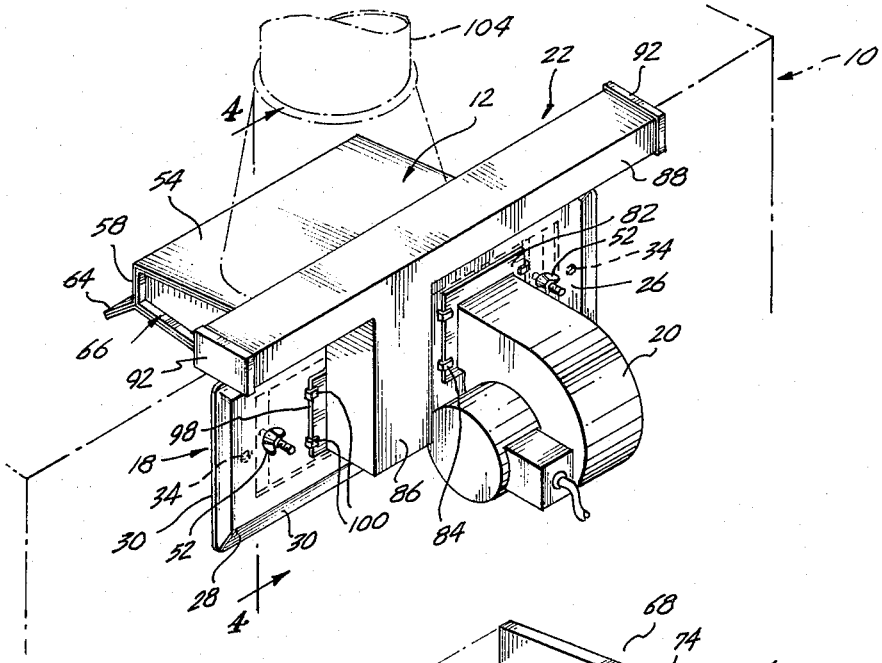
FIG. 3 is a rear pictorial view depicting the attachment of the blower and hot air manifold to the mounting plate with the stove shown in phantom.

Referring initially to FIG. 1, shown installed in a stove 10 is a typical air heater constructed according to the instant invention. In preferred form, it comprises an air heating chamber 12, shown in FIGS. 1 and 2 as extending through opening 14 provided in rear wall 16 of stove 10. Mounting plate 18, as best shown in FIG. 5, forms the exterior end wall of heating chamber 12, which mounting plate is shown in FIGS. 1 through 4 as connected to the outside of rear wall 16 to support heating chamber 12 cantilevered in the interior of stove 10. Forced air is delivered to heating chamber 12, as illustrated in FIGS. 2 and 3, by blower means 20 connected to the exterior surface of mounting plate 18. Hot air manifold 22, also connected to the exterior of mounting plate 18, conveys air heated in heating chamber 12 to the surrounding air space by discharging such hot air horizontally over the top surface 24 of stove 10.

Figure 4:
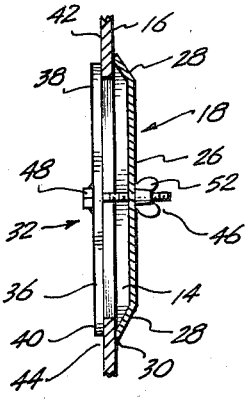
FIG. 4 is an enlarged partial cross-section of the air heater shown in FIG. 3 taken substantially along lines 4—4 thereof.
Figure 5:
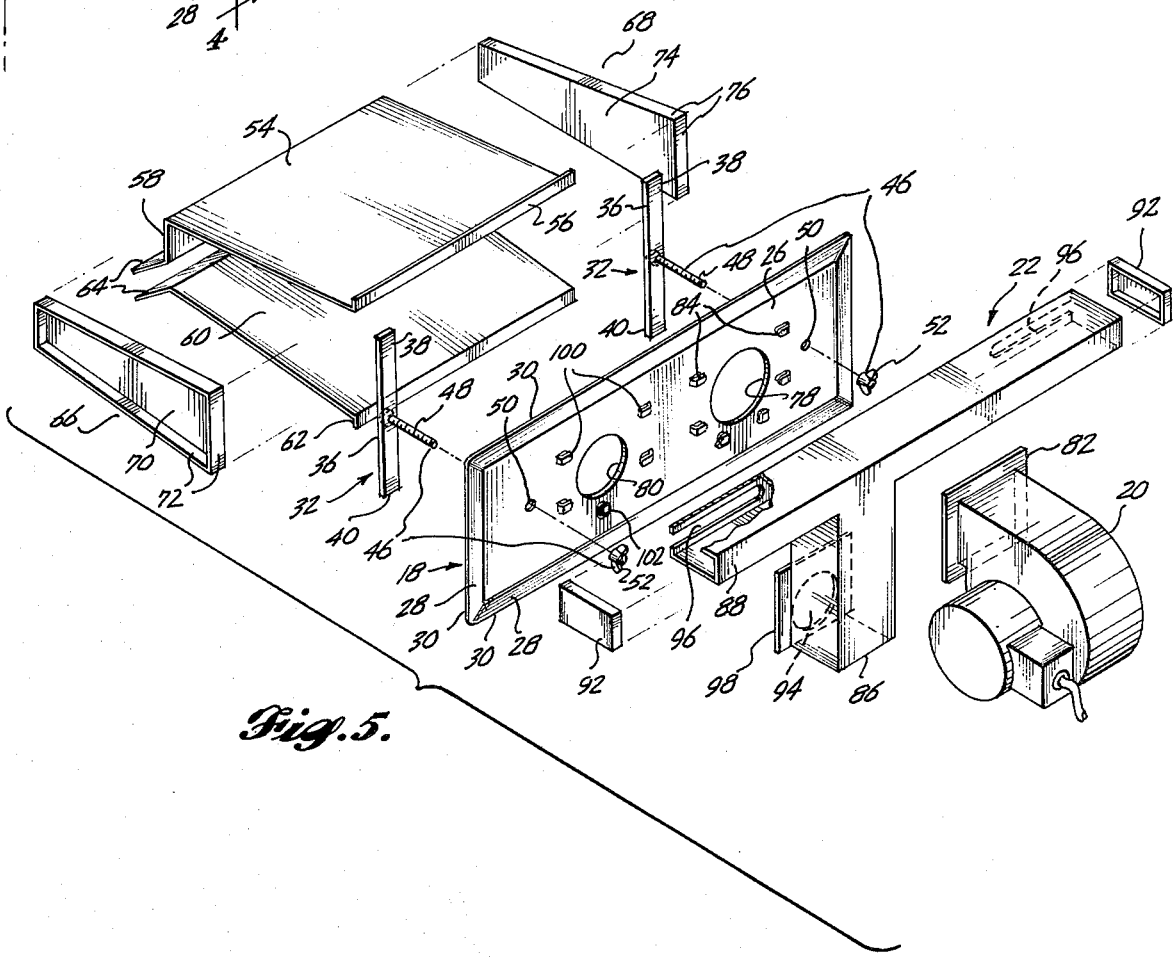
FIG. 5 is an exploded pictorial view of the air heater shown in FIG. 3.

Mounting plate 18, as shown in FIGS. 4 and 5, is constructed generally as a rectangular plate portion 26 having a flange 28 along its perimeter, which flange has an outer edge 30 projecting toward the outer surface of stove rear wall 16 to form, as shown in FIG. 4, a line contact with said rear wall to create a substantially air-tight seal when mounting plate 18 is pressed against said rear wall by mounting means 32. Mounting plate 18 is sized larger than rear wall opening 14 to enable said mounting plate, not only to cover and seal opening 14, but also to cover mounting holes 34, shown in FIG. 3, which mounting holes are normally provided in stoves having an alternative chimney opening such as opening 14. Furthermore, because mounting plate 18 is sized larger than opening 14, the same mounting plate can be used in conjunction with stove wall openings of differing sizes.

As best seen in FIGS. 4 and 5, mounting means 32, which serves to detachably mount mounting plate 18 to the stove rear wall 16, includes an elongated retainer bar 36 having a length sufficient to vertically span the height of opening 14 so that the bar upper end portion 38 and the bar lower end portion 40 bear against the upper interior side wall portion 42 and the lower interior side wall portion 44, respectively, of the stove opening 14. Fastener means 46 draws together retainer bar 36 and mounting plate 18 with the side wall portions of opening 14 sandwiched therebetween. Said fastener means is composed of cap screw 48 extending through a hole provided generally centrally along the length of retainer bar 36 and then through hole 50 provided vertically centrally in the end portion of mounting plate 18 so that the free end of such cap screw extends outward of the exterior surface of mounting plate 18; wing nut 52 engages such free end of cap screw 48. One mounting means 32 is provided at each end of mounting plate 18.

It will be understood that other mounting means to attach mounting plate 18 to stove 10 can also be provided, such as a cap screw extending through both hole 34, provided in the stove rear wall 16, and an aligned hole to be provided in mounting plate 18. The mounting means illustrated in FIGS. 4 and 5, however, have advantages over using cover mounting holes 34 to attach mounting plate 18 to rear wall 16. Retainer bar 36 can be used in conjunction with stove openings having different bolt hole patterns. Furthermore, mounting means 32 can be used in conjunction with stove openings which are not provided with mounting holes, thus eliminating the expensive and time-consuming operation of drilling such holes.

Heating chamber 12, in preferred form, as shown best in FIGS. 1 and 5, includes upper wall 54 extending outward and and generally downward from mounting plate 18. Extending upward from the edge of upper plate 54 nearest mounting plate 18 is flange 56, which flange is fixedly connected to mounting plate 18 along the upper interior edge of mounting plate portion 26. Extending downward from the free end of upper wall 54 is end wall 58, which wall forms the end of heating chamber 12 opposite mounting plate 18. Extending outward from the lower interior edge of mounting plate 18, in an upward direction, is lower heating chamber wall 60. Projecting downward from the end of lower wall 60 adjacent mounting plate 18 is flange 62, which flange is fixedly connected to mounting plate 18 along the lower interior edge of mounting plate portion 26. The free end of lower wall 60 intersects the bottom edge of end wall 58 to form the outer lower corner of air heating chamber 12; projecting outward and downward from such corner is deflecting baffle 64. The significance of deflecting baffle 64 will be discussed in a later portion of this description. The sides of air heating chamber 12 are closed off by tapered side walls 66 and 68 in spaced parallel relationship. Left side wall 66 is preferably constructed of a planar, vertical wall portion 70 having an outwardly extending flange 72 along its perimeter, which flange corresponding portions lie adjacent to and are fixedly connected to upper wall 54, mounting plate 18, lower wall 60, and end wall 58. Right side wall 68 is the mirror image of left side wall 66; it includes vertical planar side wall portion 74 surrounded by outwardly extending flange 76. Likewise, corresponding portions of flange 76 lie adjacent to and are fixedly connected to upper wall 58, mounting plate 18, lower wall 60 and end wall 58. It is to be understood that left side wall 66 and right side wall 68 can be constructed in other well known manners such as simply as a flat plate. Moreover, heating chamber 12, itself, can be constructed in other obvious configurations, such as with upper wall 54 and lower wall 60 in spaced parallel relationship rather than in spaced converging relationship.

As previously mentioned, heating chamber 12 is sized to extend inwardly into the interior of stove 10 through opening 14 provided in the rear wall 16 of such stove, and mounting plate 18, which forms the exterior end wall of heating chamber 12, is sized to cover and seal such stove rear wall opening. Therefore, as shown best in FIGS. 1 and 2, the perimeter of mounting plate 18 necessarily extends beyond the envelope of the adjacent portion of heating chamber 12.

As best shown in FIGS. 1, 2 and 5, cool room air, forced by blower means 20, enters heating chamber 12 through inlet opening 78 provided in mounting plate portion 26 and hot air exits heating chamber 12 through outlet opening 80 spaced laterally along the length of mounting plate portion 26 from inlet opening 78.

Blower means 20, as best illustrated in FIGS. 2 and 3, is detachably connected to the outer side of mounting plate 18, with the outlet opening in such blower in registration with heating chamber inlet opening 78. Blower means 20 includes rectangular mounting flange 82 located at the discharge end of such blower means, which flange is downwardly slideably receivable in a slideway defined by a plurality of tabs 84 struck out from and extending outward of the exterior surface of mounting plate 18. As shown in FIG. 5, two tabs 84 are provided to support each vertical border and the bottom border of blower means flange 82. Also, the holes created in mounting plate 18 by tabs 82, being struck out therefrom, is substantially sealed by blower means mounting flange 82.

Thus, from the foregoing description of the manner in which blower means 20 is connected to mounting plate 18, it can be appreciated that no additional hardware nor structural modification to blower means 20 is required to mount such blower to mounting plate 18. However, other well-known methods to connect blower means 22 to mounting plate 18 can be utilized, such as cap screws or studs attached to and projecting from mounting plate 18 and engageable through holes which can be drilled in mounting flange 82.

Hot air manifold 22, as best shown in FIGS. 1, 2 and 5, is constructed of an elongated, upwardly extending tubular inlet chamber 86 and an elongated, substantially horizontal, tubular outlet chamber 88 running laterally along the rear of the stove. Said outlet chamber intersects along its bottom surface at a location intermediate of its ends, the upper end of inlet chamber 86 at substantially a right angle and in fluid flow communication therewith. Although inlet chamber 86 is shown constructed of square tubing and outlet chamber 88 is shown constructed of rectangular tubing, it should be appreciated that tubings of other cross sections, such as circular, could also be readily used. The bottom end of inlet chamber 86, as shown in FIG. 2, is closed off by end plate 90 and the two ends of outlet chamber 88, as shown in FIGS. 1, 3 and 5, are closed off by end caps 92 formed to slip over the ends of said outlet chamber tube.

FIGS. 1 and 5 illustrate the air, warmed in heating chamber 12, enters hot air manifold inlet chamber 86 through hot air inlet 94 located at the lower end of the inlet chamber surface adjacent to mounting plate 18, which hot air inlet is located in registration with mounting plate outlet opening 80. Hot air is discharged from the hot air manifold 22 through horizontally elongated outlet openings 96 provided in each end of the outlet chamber vertical wall adjacent to stove rear wall 16. Hot air manifold inlet chamber 86 is of sufficient height to enable the hot air outlets 96 to be located at an elevation above the top surface of the stove, such that hot air being discharged therethrough, is blown over the top surface 24 of stove 10 towards the front of such stove. This particular construction provides the advantage that the warmed air being discharged into the room is further heated by the hot stove top surface 24. Furthermore, because the hot air manifold is located at the rear of and exterior of the stove 10, rather than in the interior front portion of such stove as in the air heater previously marketed by applicant and described above, the air heater of the instant invention can be operated with the stove front doors, commonly provided in such stoves, closed. Also, because the hot air is not discharged in the vicinity of the fire itself, sparks and burning material rising upward from the fire will not be blown into the room by such discharged air.

As previously mentioned, hot air manifold 22 is detachably connected to mounting plate 18 so that hot air inlet 94 is in registration with mounting plate outlet opening 80. To accomplish this connection, inlet chamber 86, as shown in FIGS. 3 and 5, is provided with a rectangular mounting flange 98 surrounding hot air inlet 94, fixedly connected to, and extending laterally beyond the envelope of, inlet chamber 86. Said inlet chamber mounting flange is dowwardly, slidably receivable in a slideway defined by a plurality of tabs 100 struck out from and extending outward of the exterior surface of mounting plate 18. A stop 102 is located below mounting plate outlet opening 80 and is formed by being partially struck out from mounting plate 18, said stop bearing against the bottom edge of inlet chamber mounting flange 98 to vertically position hot air manifold 22. As shown in FIGS. 3 and 5, two tabs 100 engage each vertical edge of inlet chamber mounting flange 98 to provide a substantially airtight seal between said flange and mounting plate 18. As previously mentioned concerning blower means 20, other well known means can be utilized to detachably connect hot air manifold 22 to mounting plate 18.

With the forced air heater of the instant invention in operation, cool, room air is forced by blower means 20 through mounting plate inlet opening 78 and into air heating chamber 12 and is heated while circulating therethrough. The air thus heated exits heating chamber 12 through mounting plate outlet opening 80 and enters hot air manifold inlet chamber 86 through inlet 94. Thereafter, the hot air travels upwardly through inlet chamber 86 and then horizontally through hot air manifold outlet chamber 88 and thereafter is discharged horizontally through outlet chamber openings 96 at an elevation above the stove top 24 and in a direction toward the front of stove 10.

Because, as previously discussed, air heating chamber inlet opening 78 and outlet opening 80 are both located in mounting plate 18, air entering heating chamber 12 must reverse its direction of flow prior to exiting said chamber. This directional change will tend to cause turbulence in the air circulating through heating chamber 12, and thus will insure, not only that cool air entering said heating chamber will remain in said chamber for a time length sufficient for such air to be heated, but also that the air circulating through said heating chamber will be adequately mixed to insure that the air will be heated to uniform temperature without having to provide baffles in the interior of said heating chamber.

Referring specifically to FIG. 2, combustion products flowing upward from the fire toward chimney 104 are deflected by deflecting baffle 64 to flow along the bottom wall 60 of heating chamber 12 in a direction generally towards mounting plate 14. This deflected flow of the hot combustion products ensures that heat exchanger chamber bottom wall 60 will be heated to a temperature sufficient to transfer to the air circulating through heating chamber 12 enough heat to adequately warm such air.

Preferably the forced air heater according to the instant invention will be used in conjunction with an opening in the rear firebox wall of a stove such as stove 10 shown in FIGS. 1 and 2. This installation location, as previously mentioned, enables the hot air to be discharged horizontally over the top of stove surface 24 towards the front of stove 10 so that the air being discharged is further heated by said stove top. In addition, if stove opening 14 is located in rear wall 10, most of the hot air manifold is hidden from view by the combination of stove 10 and chimney 104; as can be seen in FIG. 1 the only portion of the heater which is visible from the front of the stove are the manifold outlet openings 96 extending laterally from each side of chimney 104. Thus, the appearance of antique stoves, which are being increasingly used, is not greatly altered by the use of the instant invention. Lastly, because blower means 20 is located behind stove 10 less noise is transmitted from such blower means to the room being heated than if such blower means were mounted, for instance, in front of stove 10.

What is claimed is:

1. For use with a stove having a firebox and a rear side opening providing access into such firebox, a forced air heater comprising:

a mounting plate connectible to the stove, to extend over said rear side opening;

an air heating chamber connected to the mounting plate in cantilever fashion and sizes to fit through said opening and project into the firebox, whereby said air heating chamber is inserted into and removed out from the firebox via said opening;

said mounting plate constituting a wall of said air heating chamber and including laterally spaced apart inlet and outlet openings for the air heating chamber;

blower means on the outside of the mounting plate, serving to deliver forced air through said inlet opening and into the air heating chamber, wherein the air will circulate through said chamber before flowing to said outlet opening;

a hot air manifold connected to the mounting plate and having a hot air inlet in registry with the outlet opening in the mounting plate for receiving hot air from the heating chamber, and hot air outlet spaced above the top of the stove and located to discharge hot air horizontally over the top of the stove into space being heated by the stove; and wherein the mounting plate includes a flange along its perimeter having an outer edge projecting toward and forming a line contact with the side wall portion of the stove which borders said side opening, and mounting means for pressing said outer edge into tight contact with said side wall portion to provide a substantially airtight seal therebetween.

2. A forced air heater according to claim 1, said mounting means including, an elongated retainer bar having upper and lower end portions bearing against upper and lower interior side wall portions, respectively, of the stove bordering said side opening, and fastener means for drawing together the retainer bar and mounting plate with the side wall portions of the stove bordering side opening sandwiched therebetween.

3. For use with a stove having a firebox and a rear side opening providing access into such firebox, a forced air heater comprising:

a mounting plate connectible to the stove, to extend over said rear side opening;

an air heating chamber connected to the mounting plate in cantilever fashion and sized to fit through said opening and project into the firebox, whereby said air heating chamber is inserted into and removed out from the firebox via said opening;

said mounting plate constituting a wall of said air heating chamber and including laterally spaced apart inlet and outlet openings for the air heating chamber;

blower means on the outside of the mounting plate, serving to deliver forced air through said inlet opening and into the air heating chamber, wherein the air will circulate through said chamber before flowing to said outlet opening;

a hot air manifold connected to the mounting plate and having a hot air inlet is registry with the outlet opening in the mounting plate for receiving hot air from the heating chamber, and hot air outlet spaced above the top of the stove and located to discharge hot air horizontally over the top of the stove into space being heated by the stove; and wherein the air heating chamber includes, top and bottom walls disposed to both project into the firebox from the mounting plate and converge towards each other, spaced apart side walls interconnecting said top and bottom walls, an end wall closing the end of said chamber opposite the mounting plate, and a deflecting baffle projecting generally downwardly and outwardly from the free end of said chamber to deflecting combustion products along the bottom wall generally towards the mounting plate.

4. A forced air heater according to claim 3, wherein the hot air manifold includes an upwardly extending inlet chamber mountable onto the exterior of the mounting plate with the hot air inlet located at said inlet chamber lower end, and a substantially horizontal discharge chamber fixedly attached in fluid flow communication with the upper end of said inlet chamber, said discharge chamber having a plurality of the outlet openings for discharging hot air horizontally over the top of the stove.

5. A forced air heater according to claim 3, wherein the blower means discharge side includes a mounting flange, wherein the mounting plate includes means to detachably mount the blower mounting flange onto said mounting plate, and wherein said mounting means includes a plurality of tabs struck out from and extending outward of the exterior surface of the mounting plate, said tabs defining a slideway for slideably receiving the blower means flange to form a substantially airtight joint between the blower means flange and the mounting plate.

6. A forced air heater according to claim 3, wherein the hot air manifold includes a mounting flange surrounding the hot air inlet, wherein the mounting plate includes means to detachably mount said hot air manifold mounting flange to said mounting plate, and wherein the manifold mounting means includes a plurality of tabs struck out from and extending outward of the exterior surface of the mounting plate, said tabs defining a slide-way for slideably receiving the hot air manifold mounting flange to form a substantially airtight joint between the manifold mounting flange and the mounting plate.

* * * * *